United States Patent [19]

Borrello

[11] Patent Number: 4,741,851

[45] Date of Patent: May 3, 1988

[54] NON-CAKING BLEACHING DETERGENT COMPOSITION CONTAINING A LOWER HYDRATE OF SODIUM PERBORATE

[75] Inventor: Giuseppe Borrello, Anzio, Italy

[73] Assignee: Colgate Palmolive Co., New York, N.Y.

[21] Appl. No.: 784,437

[22] Filed: Oct. 3, 1985

Related U.S. Application Data

[63] Continuation of Ser. No. 596,122, Apr. 2, 1984, abandoned.

[51] Int. Cl.[4] ..... C11D 1/66; C11D 3/39; C11D 11/00; C11D 17/06

[52] U.S. Cl. ..... 252/91; 252/90; 252/99; 252/174; 252/174.13; 252/174.21; 252/186.31; 427/220

[58] Field of Search ..... 252/91, 95, 99, 174, 252/174.13, 174.21, 174.25, 186.3, 186.31, 383, 384, 385, 381; 427/220

[56] References Cited

U.S. PATENT DOCUMENTS

| | | | |
|---|---|---|---|
| 2,094,671 | 10/1937 | Portschke | 167/93 |
| 3,676,352 | 7/1972 | Grimm et al. | 252/99 |
| 3,915,878 | 10/1975 | Yurko et al. | 252/89 |
| 4,016,040 | 5/1977 | Win et al. | 195/68 |
| 4,276,326 | 6/1981 | Joshi | 427/220 |
| 4,351,740 | 9/1982 | Joshi et al. | 252/90 |
| 4,422,950 | 12/1983 | Kemper et al. | 252/186.38 |
| 4,539,131 | 9/1985 | Garner-Gray | 252/99 |

*Primary Examiner*—Paul Lieberman
*Assistant Examiner*—John F. McNally
*Attorney, Agent, or Firm*—B. Lieberman; M. M. Grill; H. S. Sylvester

[57] ABSTRACT

A non-caking, non-tacky and free-flowing particulate bleaching detergent composition includes a synthetic organic nonionic detergent, such as a polyethoxylated higher fatty alcohol or alkylphenol, a builder for the nonionic detergent, such as sodium tripolyphosphate, sodium silicate, sodium carbonate or a cation-exchanging sodium aluminosilicate (zeolite), or mixtures thereof, together with a sodium perborate hydrate bleaching agent, the degree of hydration of which corresponds to that of the monohydrate or less, such as 12 to 15%. The described composition, unlike similar compositions wherein the sodium perborate hydrate is the tetrahydrate, are non-caking, non-tacky and free-flowing after storage in a sealed container at elevated temperature, e.g., four weeks at 43° C., whereas a similar product in which the sodium perborate hydrate is the tetrahydrate is caked solid after such treatment.

19 Claims, 2 Drawing Sheets

NON-CAKING BLEACHING DETERGENT COMPOSITION CONTAINING A LOWER HYDRATE OF SODIUM PERBORATE

This is a continuation of application Ser. No. 596,122, filed Apr. 2, 1984, now abandoned.

This invention relates to bleaching detergent composition. More particularly it relates to non-caking detergent compositions which contain a lower hydrate of sodium perborate as the bleaching agent.

Sodium perborate, in the form of its tetrahydrate, is widely employed in the formulation of bleaching detergent compositions, some of which also contain nonionic detergents and builder. When such compositions are added to wash water at a higher temperature (near the boiling point), the perborate releases oxygen in an active form effecting bleaching of items being laundered. For laundering operations conducted at lower temperatures, substantially below the boiling point of water and sometimes near to room temperature, the composition may include an activator to facilitate release of active oxygen from the perborate during the washing operation.

Although perborate-containing detergent compositions wherein the perborate is present in the form of its usual hydrate, the tetrahydrate, may be sufficiently flowable when poured from normal detergent composition containers and packages, it has been found that when such compositions also contain nonionic detergent and builder and are held in a sealed container, which is moisture vapor-tight, at an elevated temperature for an appreciable time, e.g., a month, they cake badly. Thus, detergent compositions containing nonionic detergent, such as ethylene oxide condensation products of lipophilic moieties, builder, such a sodium tripolyphosphate, sodium silicate, sodium carbonate or a cation-exchanging sodium aluminosilicate (zeolite), or mixtures thereof, and sodium perborate tetrahydrate cake objectionably and even after breaking up of the caked composition may still be tacky and flow poorly. Such objectionable characteristics of these compositions are noted when detergent compositions of the described type are packed in dispensing bottles which are sealed on storage with a screw cap or similar closure. In such containers, which often have hollow handles communicating with the main body of detergent composition therein, it is more difficult to break up the caked material, so that it will pour, than it would be if the material had been packed in the normal or barrier-type paperboard cartons. The relatively narrow neck, the substantial rigidity of the bottle, and the presence of the hollow handle all contribute to the difficulty of dispensing a caked detergent composition from such bottles, and their usual transparency makes the consumer more aware of the objectionable caking. Now, surprisingly, it has been found that by replacement of the sodium perborate tetrahydrate in such detergent composition formulas with a sodium perforate hydrate in which the degree of hydration is lower, normally being no higher than that of the monohydrate, caking may be diminished and even prevented entirely, especially when the extent of hydration of the sodium perborate hydrate corresponds to that with no more than 18% of water in the hydrate, preferably 12 to 15% thereof.

In accordance with the present invention a noncaking particulate bleaching detergent composition comprises a detersive proportion of synthetic organic nonionic detergent, a detergency building proportion of a builder for such detergent and a bleaching proportion of sodium perborate hydrate of a degree of hydration corresponding to up to 18% water in the hydrate. Such detergent compositions will often contain from 5 to 28% of synthetic nonionic detergent, such as higher fatty alcohol polyethoxylate, 10 to 89% of inorganic builder, such as sodium tripolyphosphate, sodium silicate, sodium carbonate, cation-exchanging zeolite or mixtures thereof, 5 to 50% of sodium perborate hydrate of up to 15% moisture content, and 1 to 15% of moisture (including moisture from the sodium perborate hydrate and any other hydratable salts present). Also within the invention is a detergent composition like that described, in a sealed and resealable capped and necked bottle, which composition remains non-caking after storage for at least four weeks at a temperature of 43° C., and is readily pourable from the bottle upon opening thereof. Additionally within the invention is a process which takes advantage of the fact that the sodium perborate hydrate employed in accordance with this invention can absorb significant quantities of nonionic detergent, when that detergent is in liquid state. According to such process, at least some of the nonionic detergent is absorbed in the sodium perborate hydrate during the manufacture of the present bleaching detergent compositions. Therefore, more nonionic detergent may be employed in the present compositions without having a detrimental effect on flowability of the product. Also, because the sodium perborate hydrate utilized in this invention is of greater bleaching effect than the tetrahydrate, a lesser proportion may be utilized, leaving room in the formula for other components. Thus, larger proportions of adjuvants may be used to give the composition special effects while obtaining its desired detersive and bleaching properties.

The invention will be readily understood from this specification, taken in conjunction with the drawing in which.

Figure 1:
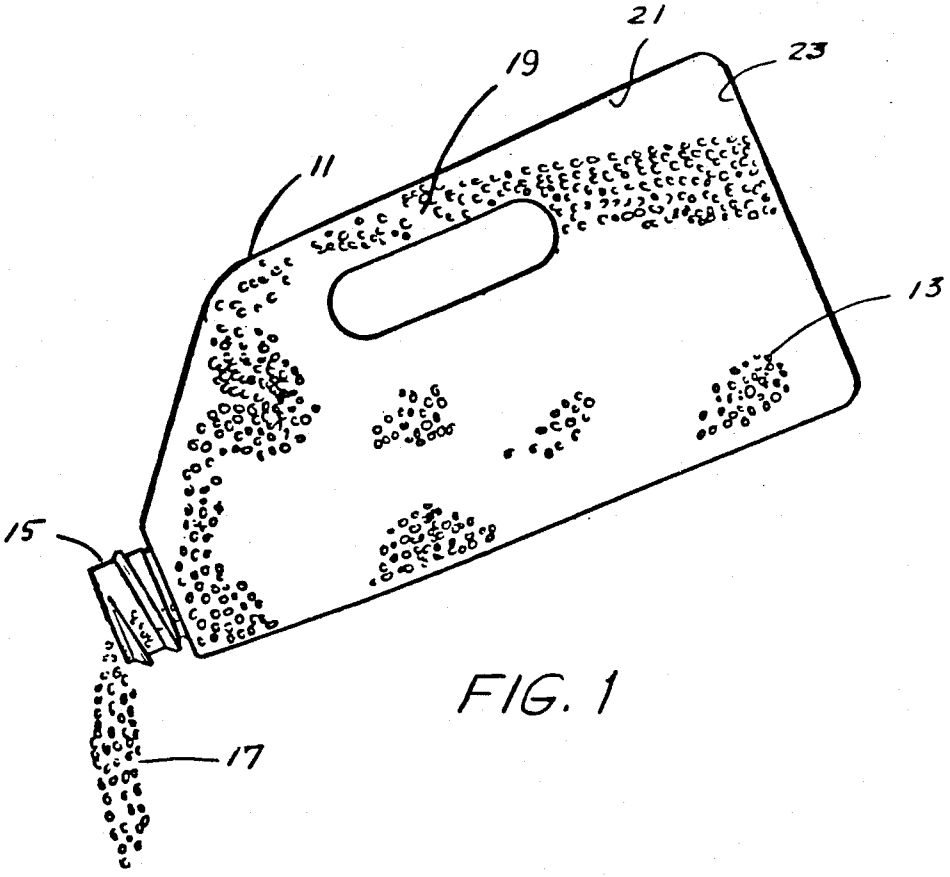
FIG. 1 is a vertical elevational view of a packaged bleaching detergent composition of this invention being poured from its container after storage at elevated temperature.

In FIG. 1 transparent plastic bottle 11, made of polymethylmethacrylate, polyvinyl chloride, polyethylene or of polypropylene is illustrated containing non-caking, non-tacky, free-flowing bleaching particulate detergent composition 13 of this invention, seen flowing from threaded neck 15 of the container to form a stream 17 of detergent composition particles. It is noted that the detergent composition particles flow freely through neck 15 despite the fact that the bottle is being tilted at only a relatively small angle, about 20°. Also, it is noted that flow of the detergent composition proceeds readily through the relatively restricted hollow handle portion 19 of the bottle. Furthermore, it is seen that the composition leaves end wall 21 and bottom 23 free of particles when the detergent composition is being dispensed, evidencing the non-tacky nature of the product. The pouring of the detergent composition illustrated takes place after cooling of the contents of the bottle to room temperature, subsequent to storage of the sealed bottle (sealed air-tight and moisture vapor-tight with a plastic screw cap, not shown) at a temperature of 43° C. for a period of four weeks. After a portion of the contents was employed for laundering purposes the bottle was resealed and subsequently was reopened for further use. The contents were still non-caking and freely flowing.

Figure 2:
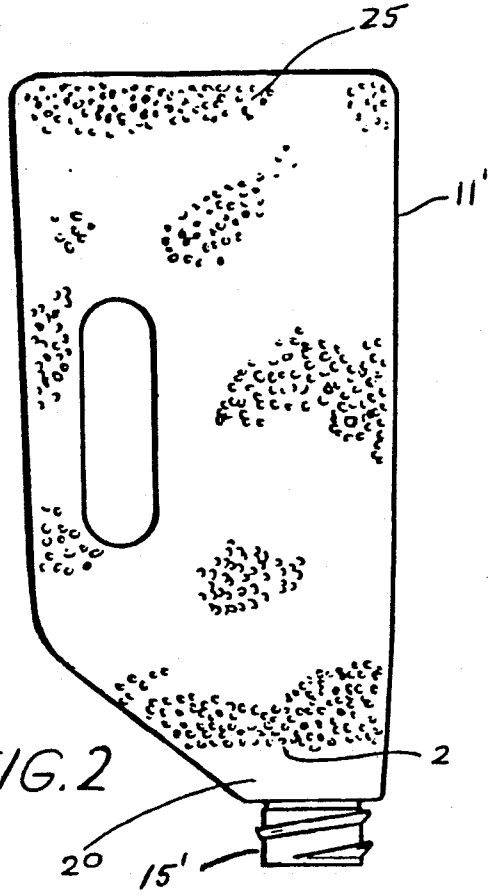
FIG. 2 is a side elevational view of a "control" composition, like that of FIG. 1 except for the employment of sodium perborate tetrahydrate as the bleaching component, which cannot be poured from its bottle after being stored at elevated temperature.

In FIG. 2 the bottle 11', identical with that of FIG. 1, contains a "control" detergent composition 25, exactly like the composition of FIG. 1 except for the inclusion of sodium perborate tetrahydrate in the composition instead of the sodium perborate hydrate utilized in the present invention. Such bottle, with the contents thereof sealed inside, had been subjected to the elevated temperature treatment mentioned for the product shown in FIG. 1, and composition 25 in the bottle had caked. In some instances liquefaction of the control composition has been noted. The contents could not be readily discharged from bottle 11' after cooling to room temperature, even when the bottle was held with the discharge opening thereof at the bottom, as illustrated. When the bottle was vigorously shaken some material could be dispensed but the bulk of it remained caked, poorly flowing and tacky. Note that the particles of the composition have formed a solid mass, the bottom of which is at surface 26, and that volume 28, below such surface is empty.

Figure 3:
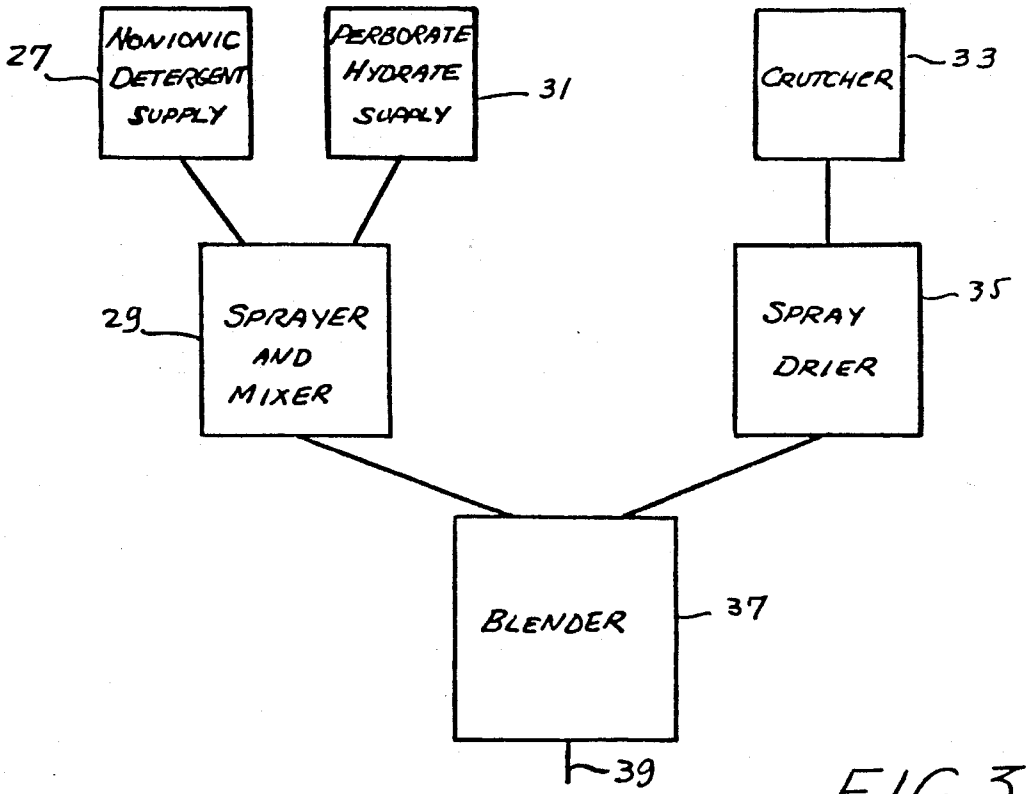
FIG. 3 is a flow diagram of a process of the present invention.

In FIG. 3 base detergent beads, comprising builder, adjuvants and a relatively small percentage of moisture, are produced by crutching an aqueous crutcher mix of such components in crutcher 33 and feeding the crutcher mix to spray dryer 35, from which the desired base beads are obtained and fed to blender 37, wherein they are mixed with particles of sodium perborate hydrate of this invention which have nonionic detergent absorbed in them. Such perborate-nonionic detergent particles are made by feeding nonionic detergent, in liquid state, from a nonionic detergent supply tank 27 to spraying and mixing apparatus 29, wherein the nonionic detergent is sprayed onto moving surfaces of the sodium perborate hydrate, which was fed to such apparatus from bin 31. Various other detergent composition components may also be incorporated in the composition in the spraying and mixing apparatus 29, the crutcher 33 or the blender 37, such as perfumed, enzymes, soil release promoting agents, stabilizers, activators, colorants, fabric softening agents and flow promoting ingredients. The desired product is removed from the blender, preferably continuously, through an outlet represented by line 39, and proceeds to packing, warehousing and shipping.

The nonionic detergent component of the invented compositions may be any suitable nonionic detergent of satisfactory cleaning properties and physical characteristics, including condensation products of ethylene oxide and propylene oxide with each other and with hydroxyl-containing bases, such as alkylphenols, Oxo-type alcohols and higher fatty alcohols, such as the higher linear alcohols. It is preferred that the nonionic detergents be such as to be normally solid at room temperature but to melt at temperature near to room temperature, e.g., 45° to 50° C., so that they may be in liquid state when applied to base beads or the sodium perborate hydrate utilized in conjunction with the present invention, but may solidify promptly thereafter, although nonionics which are already liquid at room temperature can be absorbed as well. Among useful nonionic detergents are the polyethoxylated alkyl phenols wherein the alkyl is a linear or near linear alkyl of 7 to 12 carbon atoms, preferably 8 to 9, and which contain from 3 to 30 moles of ethylene oxide, preferably 3 to 15, e.g., 9 moles thereof per mole of the phenol. The much preferred nonionic detergents are the condensation products of from 3 to 20 moles of ethylene oxide with a mole of higher fatty alcohol, preferably linear alkanol, of 10 to 18 or 20 carbon atoms. Preferably from 6 to 15 moles of ethylene oxide are present per mole of higher alcohol and more preferably the range is 6 to 9 or 11. The alcohol will have an average of from 12 to 15 carbon atoms per mole. More preferably, 6, 6.5, 7 or 11 moles of ethylene oxide will be present per mole of higher alcohol of 12 to 15 carbon atoms per mole. Among the useful nonionic detergents are those sold under the trademarks Alfonic® 1214-60C by Conoco Division of E. I. DuPont de Nemours, Inc., and Neodols® 23-6.5 and 25-7, available from Shell Chemical Company, or equivalent types.

Mixtures of various nonionic detergents may be utilized or a single such product may be employed. Also, while it is preferred that only nonionic detergent be employed, it is within the scope of the invention to employ anionic detergent(s) in conjunction with the nonionic detergent(s), providing that it does not adversely affect the properties of the composition. Among the anionic detergents which may be utilized are the water soluble higher linear alkyl benzene sulfonates, e.g., sodium linear dodecylbenzene sulfonate, olefin sulfonates, paraffin sulfonates, monoglyceride sulfates higher fatty alcohol sulfates, e.g., sodium lauryl sulfate, and high fatty alcohol polythoxylate sulfates. In such compounds the higher fatty groups will normally be of 8 to 20 carbon atoms, preferably 10 to 18 and more preferably 12 to 16. The number of moles of ethylene oxide per mole of detergent will usually be in the range of 1 to 20, preferably 3 to 10; if present. Usually the proportion of anionic detergent, if present, will be less than that of nonionic detergent, sometimes being from 10 to 50% thereof. While amphoteric and cationic detergents and surface active agents may also be present, any contents thereof will normally be small. It may sometimes be desirable to utilize quaternary ammonium fabric softening agents, such as the di-lower alkyl di-higher alkyl quaternary ammonium halides, e.g., dimethyldistearyl ammonium chlroide or diethyldipalmityl ammonium bromide, but such are considered to be adjuvants rather than detergents.

Various builders and combinations thereof which are effective to increase the detergency of the nonionic detergent and the detergent composition and to improve general washing properties of such composition include both water soluble and water insoluble builders. Among the water soluble builders the inorganic salts are preferred but various organic builders may also sometimes be used, such as sodium citrate, trisodium nitrilotriacetate, organic phosphates, gluconates and polyelectrolytes. Among the water insoluble builders those which are preferred are the naturally occurring zeolites and zeolite-like materials and other ion-exchanging insoluble compounds that act as detergent builders. Of the various zeolites, A, X and Y are preferred with Zeolite 4A being most preferred. Generally, such zeolite will be of the formula $$(Na_2O)_x.(Al_2O_3)_y.(SiO_2)_z.w\ H_2O,$$

wherein x is 1, y is from 0.8 to 1.2, z is from 1.5 to 3.5 and w is from 0 to 9, preferably being 2.5 to 6. Such zeolites are characterized by having a high ion exchange capacity for calcium ion, which is normally for about 200 to 400 or more milligram equivalents of calcium carbonate hardness per gram of the aluminosilicate, on an anhydrous zeolite basis. The zeolite will normally be of a moisture content in the range of 5 to 30%, preferably 15 to 25%, e.g., about 20%.

The preferred water soluble inorganic builder salts employed in accordance with this invention include polyphosphates, carbonates and silicates, usually as the alkali metal salts and preferably as the sodium salts. While pyrophosphates may be present the preferred polyphosphate is sodium tripolyphosphate, and normally a hydrated or water treated form thereof will be utilized. Instead of sodium carbonate, sodium sesquicarbonate can be present instead of a mixture of sodium carbonate and sodium bicarbonate may be employed, depending on the product characteristics desired. The sodium silicate will usually be charged to the crutcher mix in liquid form but in this specification the proportion thereof given is on an anhydrous basis, which is also true with respect to the other components (except for the perborate and any hydrated polyphosphate). The sodium silicate will usually be of $Na_2O:SiO_2$ ratio in the range of 1:1.6 to 3.0, preferably 1:1.6 to 2.4, e.g., 1:2.0, 1:2.4. Various other suitable builder salts may be employed and various mixtures thereof may be utilized. However, it is most preferable that the primary builder salt be sodium tripolyphosphate and that there also will be present with it sodium silicate and/or zeolite. In those instances wherein phosphate is to be avoided because of eutrophication problems, zeolite(s), mixtures of carbonate and zeolite, carbonate and bicarbonate, and carbonate, bicarbonate and zeolite, (in such compositions silicate may also be present) or other nonphosphate builder combination may be utilized.

The sodium perborate hydrate employed in accordance with this invention, is one, the hydration of which corresponds to considerably less moisture than that of the perborate tetrahydrate. Thus, where sodium perborate tetrahydrate includes about 47% of moisture and about 10.4% of active oxygen, the monohydrate contains about 18% of moisture and about 16% of active oxygen. The active oxygen content is about the same over a range of moistures from about 12 to 18% but the lower portions of this range, 12 to 15% or 12 to 14%, e.g., 13%, are found more useful because it is such that the non-caking characteristic of the detergent composition is best maintained and unduly rapid release of oxygen from the composition in the wash water does not occur, which has been noted when the perborate of such compositions included less than 12% of water of hydration. The useful perborate hydrates may be made by heating sodium perborate tetrahydrate to drive off the desired proportion of moisture. While it is possible to mix perborate hydrates of different moisture contents to obtain the desired average moisture such procedure is considered to be inferior to controllably dehydrating the perborate tetrahydrate to the desired moisture content, so that the perborate particles are very similar in moisture contents.

In addition to the three major components (and water) of the present compositions various adjuvants may also be present. Among such are soil release promotion compounds, fabric softeners, enzymes, stabilizers, activators for the perborate, anti-gelling and anti-setting agents, anti-oxidants, colorants, perfumes, fluorescent brighteners, dispersing agents, sequestrants, flow promoting agents, fillers, bead strength improvers, anti-foams, bactericides, fungicides and bead density modifiers.

Preferred soil release promoting compounds are the copolymers of polyethylene terephthalate and polyoxyethylene terephthalate of molecular weights in the range of about 15,000 to 50,000, preferably 19,000 to 43,000, more preferably 19,000 to 25,000, e.g., about 22,000. In such polymers the polyoxyethylene will be of a molecular weight in the range of 1,000 to 10,000, preferably 3,000 to 4,000, e.g., about 3,400 and the molar ratio of polyethylene terephthalate to polyoxyethylene terephthalate units will be within the range of 2:1 to 6:1, preferably 3:1 to 4:1, e.g., about 3:1. In such copolymers the proportion of ethylene oxide to phthalic moiety in the polymer will be at least 10:1 and often will be 20:1 or more, preferably being within the range of 20:1 to 30:1, e.g., about 22:1. Such materials are obtainable from Alkaril Chemicals, Inc., under the trademarks Alkaril QCJ and Alkaril QCF. Other copolymers of this type but of different molecular weights and proportions of components may also be used but are not considered to be as effective. Among the useful fabric softeners, in addition to the quaternary ammonium halides, previously mentioned, are sodium bentonites, such as Wyoming or western bentonites, which often have good gelling and cation exchange capacities (over 50 milliequivalents of calcium ion per hundred grams). Enzymes that are useful include proteolytic and amylolytic enzymes, e.g., Maxatase and Esperase 4T. Such enzymes, as referred to herein, are commercial preparations which include a carrier with the active ingredient (weights given herein are with respect to the preparations, as supplied). Enzyme stabilizers, including sodium formate and formaldehyde, may be present, as may be stabilizers for other components of the composition. Activators for the perborate include N-acetyl caprolactam and acetamides, and those known as TAED, TAGU and PAG, as well as other chemicals containing active acetyl groups that can produce peracetic acid. Among the anti-gelling and anti-setting agents may be mentioned citric acid, sodium citrate and magnesium sulfate, the citric materials normally being employed in small adjuvant quantities rather than in larger builder proportions. Antioxidants, colorants, perfumes, bactericides and fungicides are well known in the art and are minor components of the invented products, so they will not be discussed further. Fluorescent brighteners are usually of the stilbene type, such as Tinopal CBS-X and Tinopal 5BM. Among useful dispersing agents are the polyacrylates, which also contribute to bead strength and allow control of bead density. Sequestrants, such as NTA, EDTA and citric materials (in small proportions) may be present. Among the flow promoting agents magnesium silicates are preferred. There is normally little room in the present formula for fillers but a useful filler, which is also a crutcher mix improving agent, is sodium sulfate and sometimes it is possible to include this in the formula because of the "hole" left by replacement of a larger proportion of sodium perborate tetrahydrate with a smaller proportion of the lower hydrate. Among useful anti-foams are the well known dimethyl silicones and soaps, such as sodium tallow soaps, sodium hydrogenated tallow soaps and sodium stearate. In larger proportions such soaps may be employed for their detergent contribution too, in substitution for anionic detergent, when such was present in these compositions.

While in the broadest sense of the present invention proportions are not critical, there are certain proportions which are highly desirable for best functioning of the invention. Thus, the content of synthetic nonionic organic detergent will usually be within the range of 5 to 28% of the composition. Below 5% insufficient detersive activity is noted and it appears that about 28% is the upper limit of nonionic detergent content in the present product without resulting in tackiness and a susceptibility to caking of the product. Preferably, especially when the synthetic nonionic detergent is an ethylene oxide condensation product of a higher fatty alcohol or an alkyl phenol, and no other detergent is present, the proportion thereof will be from 10 to 25%, more preferably 14 to 22% and most preferably about 18 to 20%. The proportion of inorganic builder is normally in the range of 10 to 89%, preferably being 30 to 55% and most preferably being from 35 to 50%, e.g., 39% and 45%. For those compositions containing sodium tripolyphosphate as the principal builder the proportion thereof will usually be from 30 to 55%, preferably 35 to 50%, e.g., 37% and 43%. Normally sodium silicate is present with the polyphosphate and the proportion thereof will be from 1 to 10%, preferably 1 to 8% and more preferably 2 to 4%, e.g., about 2 or 3%. However, in some instances larger proportions of silicate may be employed, usually when instead of polyphosphate being present, in non-phosphate formulas, zeolite, carbonate and/or bicarbonate are present instead. In such instances the silicate content may be from 2 to 10%, preferably 3 to 5%. The contents of carbonate, bicarbonate and zeolite vary according to the formulas. When zeolite is utilized with tripolyphosphate it will normally be present in a proportion about 1/5 to ½ that of the tripolyphosphate but up to an equal proportion of zeolite may sometimes be used. In non-phosphate compositions the percentages of zeolite will normally be from 5 to 25%, preferably 10 to 20%. Proportions of carbonate in non-phosphate compositions may be from 5 to 30%, preferably 10 to 25%, as may be the proportions of bicarbonate.

The sodium perborate hydrate component of this invention will generally be within the range of 5 to 50% of the composition, preferably 10 to 30% and more preferably from 15 to 25% thereof. When nonionic detergent is absorbed by the perborate hydrate photomicrographs show that it fills in roughnesses on the surfaces of the perborate particles, resulting in a substantially smooth surfaced bead which flows better than do roughened particles of the same composition. While below 12% moisture content the hydrate may too readily release oxygen in the wash water, in some instances such quick release may be desirable and therefore the moisture content may be as low as 1% and the range of such contents may be from 1 to 15% or 1 to 14%. The lower moisture content hydrates within such range may be more absorptive of nonionic detergent than those of higher moisture.

The proportion of moisture in the present compositions will normally be in the range of 1 to 15%, although it is contemplated that in the presence of certain components, such as zeolite and/or bentonite, a higher moisture content limit may apply, e.g., 18%. Such moisture includes moisture in the sodium perborate hydrate and includes other readily removable moisture from other hydrates which may also be present. A preferred moisture range is 5 to 15% and more preferred is 10 to 13 or 14%. Adjuvants that are present are desirably limited to from 1 to 15%, with individual adjuvants normally being present in a proportion not greater than 10%, e.g., 0.1 to 8%. Of course, the proportions of adjuvants depend on their nature and function so ranges for only a few components will be given here. Normally, the proportion of soil release promotion compound will be from 1 to 10%, preferably 3 to 8%, which range is also suitable for a fabric softening agent, such as bentonite. Quaternary ammonium halide fabric softeners may be present in a proportion from 0.5 to 4% and enzymes normally constitute from 0.2 to 2%. Activators for the perborate may be from 0.1 to 4% and anti-gelling and anti-setting agents may be from 0.2 to 3%. Perfumes and colorants will normally constitute from 0.1 to 1% and flow promoting agents may be from 0.5 to 5%. Anti-redeposition agents, such as CMC, may be from 0.5 to 3%, and polyacrylates may be from 0.05 to 1%. Fillers, such as sodium sulfate, which also serves to improve particle properties and flow while desirably affecting mix of the crutcher slurry when it contains sodium tripolyphosphate, may be from 0.5 to 8 to 10%.

In an important embodiment of this invention the described compositions are packed in hermetically sealed bottles, which resemble blow-molded bottles that are conventionally used to hold liquid detergents. However, the present bottles are very preferably clear, so that the attractive particles of the product may be seen by the user. Often the detergent composition particles are colored, sometimes multicolored, and it is desirable to be able to see them. One may also note how the product flows and one can see that it does not adhere to container walls. Materials for the container have previously been described and the present discussion will be limited to disclosures of some of the salient features of the bottles and their dimensions. The bottles can fairly be characterized as narrow necked, relatively speaking, with the neck generally being round and of an open cross-sectional area in the range of 2 to 40 sq. cm. The hollow handle has a cross-sectional area for the opening therein in the range of 1 to 10 sq. cm.

The compositions of this invention are free-flowing, often flowing through a suitable restricted orifice at a rate about 70% or more that of dry sand. At the least the flow rate is comparable to those of other free-flowing detergent powders. Thus, the bottles are readily filled by automatic filling equipment and the particles of detergent composition easily fill the hollow handle portion. Of course, bottles without such handles, and containing the invented compositions, are also within the product aspect of this invention. After the heat storage test previously described, and after cooling, the invented compositions readily flow through the handle and out the bottle when such is tilted only slightly, and flow at a rate approximately the initial flow rate. Similarly, the product flows readily, does not cake and is not tacky after the bottle is recapped, is stored again at elevated temperature, is opened and is placed in pouring position, as illustrated in FIG. 1 of the drawing.

The manufacture of the invented compositions is essentially straightforward and does not require the use of equipment not normally employed in the detergent industry. Of course, there are different ways that the perborate hydrate may be combined with the constituents of the bleaching detergent composition. It may be blended with the other individual components, with the dry powders being mixed and with the liquid components being sprayed or dripped onto the surfaces of the moving powders. This is not preferable because it is desirable to have the composition in non-dusting form, such as in beads of the type obtained from spray drying operations. Because sodium perborate decomposes at elevated temperatures, such as those that obtain in a spray drying tower (200° to 500° C.) the perborate will not be included in the crutcher mix and will be post-added to any materials that are spray dried. However, the perborate hydrate of this invention may be mixed with spray dried base beads containing all or almost all of the other components of the detergent composition and then have nonionic detergent applied to the mixture in a tumbling drum, fluidized bed, coating pan, V-blender, zig-zag blender or similar equipment.

Preferably, the perborate hydrate will be "loaded" with nonionic detergent in liquid state at elevated temperature, usually in the range of 50° to 65° C., e.g., 55° C., 60° C., with the load being to the extent of 20 to 30% nonionic, and this product, at room temperature, will be mixed with room temperature base beads to which the desired additional proportion of nonionic detergent, if any, has previously been added. It has been found that as much as 30% of nonionic detergent may satisfactorily be absorbed into the perborate hydrate particle and, as previously discussed, the solidifed detergent covers pits on the surfaces of the particles, making it more readily free flowing. Better absorption is obtainable when the moisture content of the perborate hydrate is less than the theoretical amount of about 18%, with the range of 12 to 15% being preferred, especially 12 to 14%, and with 13% being most preferred. In another embodiment of the invention the perborate hydrate may be nonionic detergent absorbed into it and separately spray dried particles of sodium tripolyphosphate, either hydrated or anhydrous, may similarly have nonionic detergent absorbed by them, although the limit of absorption is about 20% for the tripolyphosphate, and a reasonable range of nonionic detergent contents of such product is about 5 to 20%. Then, these two components may be mixed with the vaious other components of the composition, which may be in agglomerated form so as to improve the particle sizes thereof, with all or substantially all the particles desirably being in the range of 8 to 140 mesh (over 90% and preferably over 95% by weight of the articles being in such range). If more than the allowable limit of particles is outside such range, screening is employed to remove them. For purchases materials specifications will be set so that the particles will be in the desired size range. The mesh sizes given above correspond to U.S. Sieve Series screen numbers.

The advantages of the invention have already been referred to. Primarily, a caking problem which could seriously interfere with marketing of bleaching nonionic detergent compositions in sealed bottles has been overcome. By replacement of sodium perborate tetrahydrate with the lower hydrates, in accordance with this invention, stability of the product against such caking and prevention of the development of poor flow properties and tackiness are achieved. In addition, because the perborate lower hydrate absorbs more nonionic detergent, larger quantities of such detergent may be included in the composition without causing caking, poor flow and tackiness. Because the lower perborate hydrate includes about 50% more active oxygen than the perborate tetrahydrate less can be used and other components can be incorporated in the product to further improve its characteristics. Thus, the final result is an improved and stable product which has the desired bleaching properties of the corresponding compositions based on sodium perborate tetrahydrate and is of excellent detergency, equal to that of the perborate tetrahydrate compositions, while being non-caking, free-flowing, non-tacky, more absorptive of nonionic detergent and better able to provide flexbility of formulation, due to the "hole" left in the formula by elimination of the water of hydration of the tetrahydrate.

The following examples illustrate but do not limit the invention. Unless otherwise indicated all parts are by weight and all temperatures are in °C.

EXAMPLE 1

| Component | Parts |
|---|---|
| Water[1] | 54.3 |
| Sodium silicate ($Na_2O:SiO_2$ = 1:2.0)[2] | 6.8 |
| Sodium tripolyphosphate (hexahydrate)[3] | 42.7 |
| Sodium carboxymethyl cellulose (detergent grade) | 1.5 |
| Magnesium silicate (flow improver) | 0.5 |
| Fluorescent brighteners[4] | 0.3 |
| Colorant (blue dye and pigment) | 0.04 |
| | 106.14 |

[1]City water of less than 150 p.p.m. hardness as ($CaCO_3$) or deionized water
[2]44.1% aqueous solution
[3]Other hydrated STPP may be substituted
[4]Mixtures of 0.24 part of stilbene brightener No. 4 (Colgate-Palmolive Co. designation) and 0.06 part Tinopal CBS-X A crutcher mix of the above formula is made by adding the various components to the water thereof, which is charged to a standard detergent crutcher, and the mix is heated to a temperature of about 50° C. It is then spray dried in a conventional countercurrent spray tower with the tower temperature being about 350° C. During drying enough water is removed from the product so that is final moisture content is about 16%. The spray dried beads obtained are free-flowing particles substantially all of which are within the range of 8 to 140 mesh, with over 75% of the particles being within the range of 20 to 80 mesh.

To 56.9 parts of the spray dried beads there are added 17 parts of sodium perborate hydrate which has a moisture content of about 13%, 1 part of a phosphoric acid ester of a mixture of approximately equal parts of cetyl and stearyl alcohols, and 0.8 part of enzyme (Esperase 4.0 T). To this mixture there are added 16 parts of a condensation product of ethylene oxide and higher fatty alcohol (7 moles of ethylene oxide per mole of higher linear fatty alcohol of 12 to 15 carbon atoms) which is at a temperature of about 60° C., and the addition is by spraying or dripping the nonionic onto the tumbling particles of the other components. The composition is mixed untilt he fatty alcohol is satisfactorily distributed over the various particles and is absorbed by them. During mixing 0.4 part of perfume is added. When mixing is complete, which takes about ten minutes, the product is removed from the mixer (screened, in some instances) and is filled into clear polyacrylate bottles having hollow handles and relatively narrow necks, which bottles are then sealed, cartoned, warehoused and shipped.

The bleaching detergent composition made is of particles within the size range previously given for the spray dried components (the perborate starting material was also of such a size). It is of a density of 0.7 g./cc., and is free flwoing. The product contains about 17% of the nonionic detergent, 46% of sodium tripolyphosphate, 17% of the sodium perborate hydrate, 3% of sodium silicate, 1% of phosphoric ester, 1% of sodium carboxymethyl cellulose, 0.9% of enzyme, 0.5% of flow promoter, 0.4% of perfume, corresponding minor percentages of the other adjuvants and about 15% of moisture (including that in any hydrates from which it is removable at 105° C.).

When the hermetically sealed container of the bleaching detergent composition of this invention is subjected to a stability test, by being kept at a temperature of 43° C. for a period of four weeks, the product passes the test. In such test the bottle and contents are allowed to cool down to room temperature before the bottle is opened and then the contents are poured out of the bottle. It is noted that they pour relatively easily, do not cake and do not adhere to the walls of the bottle. By a standard test employed to measure flow rate they flow through a restricted orifice at a rate about 70% of that of dry sand. Even when the heated materials are poured from the open bottle while still warm, they flow well. Chemical analyses show that the active oxygen content of the perborate has not diminished during storage and also the $p_2O_5$ content of the polyphosphate has not been decreased. The product is an attractive free-flowing detergent composition which can satisfactorily withstand elevated temperatures likely to be encountered during normal warehousing, shipping and storage before use. When tested in laboratory, commercial and home washing machines wherein washing is conducted at elevated temperature, e.g., 75°-90° C., the composition is found to have excellent washing and bleaching properties against normal laundry soils and against various stains. Such properties are retained during the normal use of the product, which involves repeated openings and closings of the polyacrylate bottle, and the product remains non-caking, non-tacky and readily flowable during such repeated uses.

When 13% moisture sodium perborate hydrate is replaced by other such hydrates, such as those of moisture contents of 12, 14 and 15%, essentially the same results obtain and the product is non-caking on elevated temperature storage in sealed containers. Similar results are obtainable when instead of the sodium tripolyphosphate a mixture of approximately equal parts of sodium carbonate and sodium bicarbonate is substituted or when half of the tripolyphosphate is substituted by hydrated Zeolite 4A (20% water of hydration). However, the flowability of the non-phosphate product is not as good as that of the primary product of this example.

Results like those of the primary example herein are also obtainable when no flow improver is employed, but flow rates will be somewhat diminished. Similarly, when the only components are the perborate hydrate, tripolyphosphate, nonionic detergent and sodium silicate, in the proportions shown in this example, an excellent detergent is obtained but the various desirable properties of the adjuvants are wanting.

When the 17 parts of ther perborate hydrate of this example are replaced by sufficient sodium perborate tetrahydrate to have the same active oxygen content and the product resulting is heat tested by the method previously described herein such product is found to cake badly and in some instances liquid may be observed among the particles of this "control" composition. Thus, it is considered that the control composition is unacceptabe for commercial use in sealed containers, like the bottles that have been mentioned. It is also considered that the control is unacceptable for use in barrier cartons which are moisture-tight.

EXAMPLE 2

Sodium perborate tetrahydrate particles of sizes in the 8 to 140 mesh range are partially dehydrated, to moisture contents in the range of 12 to 15% by controlled heating, as by fluidized bed heating or by passing them through a heated pipe at a controlled flow rate. During such heating operations the particles swell slightly but at the conclusion of it they are within the desired size range (8 to 140 mesh) and of desirable density (about 0.5 or 0.6 g./cc.) so that the final product may have a density of about 0.7 g./cc. Particles so made are employed as sorbents for nonionic detergent, as described herein.

A nonionic detergent like that described in Example 1 is heated to 60° C. and is coated onto and absorbed in the perborate hydrate particles by being sprayed onto such particles while they are kept in motion in a pan granulator or coater. Instead of the described equipment there may be employed various other types of mixers, including inclined drums, Day mixers and V- and zig-zag blenders. Mixing may be continuous or batch. The type of blender or mixer employed is one which will not tend to cause disintegration or agglomeration of the particles. It is found that the nonionic detergent - perborate hydrate particles obtained are free flowing, of the desired particle size (8 to 140 mesh) and smoother in appearance than the perborate particles were initially. When the moisture content of the perborate is less than 12% and such experiment is repeated good nonionic absorption is also obtainable but when the moisture content is higher than about 18% sorption is much diminished. For example, sodium perborate tetrahydrate is not a good absorber for nonionic detergent.

The sodium perborate hydrate, containing about 30% of nonionic detergent (total basis), is mixed with spray dried detergent base beads like thos of Example 1 after such base beads have been mixed with the balance of the formula, except perfume, with allowance being made in the formula for the nonionic detergent previously mixed with the perborate. Subsequently perfume is mixed in and after five or more minutes mixing at room temperature the product is ready for packaging, which is effected in the manner described in Example 1.

The product made is of the same composition as that of Example 1 but because of preliminary absorption of nonionic detergent by the perborate hydrate particles the absorption of the balance of the nonionic detergent during manufacture proceeds more readily. The product of this exapmle is resistant to decomposition and deterioration at elevated temperatures by the test method previously described. It is non-caking and free flowing after such test and is an excellent bleaching detergent.

In variations of this example the percentage of perborate hydrate is increased to 25% in the final product, with the other components being correspondingly decreased. A product of greater bleaching effectiveness is obtained than when 25% of sodium perborate monohydrate is employed in the same type of formula. Also, the active oxygen and $P_2O_5$ contents of the product are substantially retained, whereas those of the "control", containing perborate tetrahydrate, are decreased after storage at elevated temperature.

In another variation of this example the perborate of this invention, containing nonionic detergent, may be mixed with the spray dried base beads, followed by mixing with othe components, including the balance of nonionic detergent. The resulting product is a satisfactory bleaching detergent and withstands the elevated temperature test well. In a further variation the nonionic detergent is absorbed separately by the base beads and perborate hydrate parts of the composition and then such are mixed together. The proportions of nonionic employed in each absorption step will be the maximum absorbable proportion for absorption by the perborate hydrate, with the balance of nonionic being absorbed by the base beads (principally by the sodium tripolyphosphate). The product will resist elevated temperature storage in sealed bottles without caking. A further modification of the described techniques is to dry mix the various components of the composition, after having first absorbed nonionic detergent onto the perborate hydrate particles and the sodium tripolyphosphate particles. However, dry mixes are not generally preferred and if they are made, certain liquids, such as perfumes and sodium silicate solution, will still have to be mixed in and satisfactorily distributed throughout the composition.

EXAMPLE 3

A composition comprising 18% of nonionic detergent (about equal parts of ethoxylated fatty alcohols of 16 to 18 carbon atoms and 3 and 12 moles of ethylene oxide per mole of fatty alcohol), 35% of sodium tripolyphosphate, 11% of hydrated Zeolite 4A (20% water content), 8% of sodium silicate of $Na_2O:SiO_2$ ratio of about 1:2, 6% of sodium perborate hydrate (14% moisture), 3% of tetraacetylethylenediamine (TAED perborate activator), 1% of sodium carboxymethyl cellulose, 0.2% of stilbene fluorescent brightener, 2% of sodium formate, 1% of proteolytic enzyme, 14% of moisture and the balance of minor adjuvants, is made by the principal method of Example 2 and satisfactorily passes the heat storage test previously described. When instead of the lower hydrate of the perborate, the tetrahydrate is employed the product cakes badly. This example illustrates that instead of employing larger proportions of perborate, smaller proportions may be utilized, together with a perborate activator, such as TAED. The products made according to this example, when tested at lower washing temperatures, such as 40° to 50° C., are good detergents and effectively bleach stains because of the release by the perborate of active oxygen in the presence of the ctivator.

Similar results are obtainable when the compositions of this example are made by the other techniques described in the previous example and elsewhere in the specification.

EXAMPLE 4

The principal formula of Example 1 is modified by adding to it any of the following components: 5% of the soil release promoting copolymer of polyethylene terephthalate and polyoxyethylene terephthalate; 8% of fabric softening bentonite; 1% of dimethyldistearyl ammonium chloride; 1% of polyvinyl pyrrolidone; and/or 0.1% of dimethyl silicone. Such components may be added to the crutcher mix or are post-added after production of the base bead, as befits their stabilies. The proportions of the other components may be decreased accordingly. One or more of the five additional components mentioned may be utilized in the basic formula and the basic formulat may be varied too. For example, instead of the condensation product of ethylene oxide with higher fatty alcohol the nonionic detergent may be a condensation product of ethylene oxide with osooctyl phenol or nonyl phenol, of the type previously described, or may be a different fatty alcohol ethoxylate or mixture thereof within the specification description. The enzymes employed may be either amylolytic or proteolytic or a mixture of both. The polyvinyl pyrrolidone may be used with the CMC or partially in replacement thereof. While the soil release promoting copolymer described in the specification is preferably employed, other such materials may also be used.

The product of this example will be good bleaching detergents under the appropriate conditions of use and will be non-caking on storage at elevated temperature in hermetically sealed containers.

In addition to the modifications mentioned above, the various proportions of components of the principal formulas of the examples may be varied so that they are ±10% and ±25%, providing that they are still within the scope of the invention, as described, and the products made will be good bleaching detergents of good elevated temperature storage characteristics.

This invention has been described with respect to various examples and illustrations thereof but is not to be limited to these because equivalents and substitutes may be employed without departing from the invention.

What is claimed is:

1. A process for the manufacture of a particulate bleaching detergent component of a non-caking particulate bleaching detergent composition which is stable when stored in a sealed container at elevated temperature, which comprises absorbing a synthetic organic nonionic detergent which is normally in a solid state at room temperature, in liquid state at elevated temperature into particulate sodium perborate hydrate, the hydration of which corresponds to 12 to 15% of water in the hydrate, with the proportion of the nonionic detergent being about 5 to 30% in the bleaching detergent component, and cooling the nonionic detergent in the perborate hydrate particles to solidify it and thereby improve the flowability of the bleaching detergent component particles.

2. A process according to claim 1 wherein the bleaching detergent component particles made are mixed with particulate detergent builder to produce a particulate built bleaching detergent composition.

3. A process according to claim 2 wherien a nonionic detergent, which is normally solid at room temperature, is absorbed in liquid state at elevated temperature into sodium tripolyphosphate builder particles so that 5 to 20% of the sodium tripolyphosphate-nonionic detergent particles is nonionic detergent, and the sodium perborate hydrate-nonionic detergent particles are mixed with the sodium tripolyphosphate-nonionic detergent particles to make a particulate, build bleaching detergent composition.

4. A process according to claim 3 wherein the particulate detergent composition made comprises from 5 to 28% of the synthetic organic nonionic detergent, 10 to 89% of the sodium tripolyphosphate, 5 to 20% of the sodium perborate hydrate and 1 to 15% of moisture, including moisture from the sodium perborate hydrate, and the particulate built bleaching detergent composition is of particle sizes in the range of No's. 8 to 140, U.S. Sieve Series.

5. A process according to claim 4 wherein the sodium perborate hydrate is of a degree of hydration which corresponds to 12 to 14% of water in the hydrate, the nonionic detergent is a condensation product of from 3 to 20 moles of ethylene oxide and a mole of higher linear alcohol of 10 to 18 carbon atoms, the composition moisture content is from 10 to 14% and the composition contains from 0.1 to 20% of adjuvant(s).

6. A process according to claim 5 wherein the sodium perborate hydrate is of a degree of hydration which corresponds to about 13% of water in the hydrate, the nonionic detergent is a condensation product of about 6 to 11 moles of ethylene oxide per mole of higher alcohol, which alcohol is of 12 to 15 carbon atoms per mole, and the proportions of synthetic nonionic organic detergent, sodium tripolyphosphate, sodium perborate hydrate and moisture are in the ranges of 10 to 25%, 30 to 55%, 10 to 30% and 5 to 15%, respectively.

7. A non-caking particulate bleaching detergent composition which comprises a detersive porportion of a synthetic organic nonionic detergent, a detergency building proportion of a builder for such detergent and a bleaching proportion of sodium perborate hydrate of a degree of hydration corresponding to 12 to 15% of water in the hydrate, with the proportions of the nonionic detergent, builder and the sodium perborate hydrate being within the ranges of 5 to 28%, 10 to 89% and 5 to 50%, respectively said nonionic detergent being absorbed onto said sodium perborate hydrate.

8. A detergent composition according to claim 7, which is free flowing and is suitable for being packaged in a moisture proof container and for being stored at elevated temperature without caking or becoming slow flowing, in which the synthetic organic nonionic detergent is a condensation product of ethylene oxide and a lipophilic moiety, the builder is inorganic and the proportions of synthetic organic nonionic detergent, inorganic builder, sodium perborate hydrate and water, including water from the sodium perborate hydrate, are 14 to 22%, 30 to 55%, 10 to 30% and 5 to 15%, respectively.

9. A detergent composition according to claim 8 wherein the nonionic detergent is selected from the group consisting of condensation products of ethylene oxide with higher fatty alcohol and of ethylene oxide with alkylphenol, the builder is selected from the group consisting of sodium polyphosphate, sodium silicate, sodium carbonate and cation exchangin zeolite, and mixtures of two or more thereof, and the sodium perborate hydrate is of a moisture content of 12 to 14%.

10. A detergent composition according to claim 9 wherein the sodium perborate hydrate with nonionic detergent therein includes 20 to 30% of nonionic detergent, the nonionic detergent is a condensation product of 3 to 20 moles of ethylene oxide and a mole of higher linear alcohol of 10 to 18 carbon atoms, the builder includes sodium tripolyphosphate, the sodium perborate hydrate is of a moisture content of about 13%, the composition moisture content is from 10 to 14%, the composition contains from 0.1 to 20% of adjuvant(s) and the particle sizes are substantially all in the range of 8 to 140 mesh, U.S. Sieve Series.

11. A detergent composition according to claim 10 wherein the nonionic detergent is a condensation product of an average of about 7 moles of ethylene oxide and a mole of higher alcohol, which higher alcohol is of an average of 12 to 15 carbon atoms per mole, the builder includes hydrated sodium tripolyphosphate and sodium silicate of $Na_2O:SiO_2$ ratio in the range of about 1:1.6 to 1:2.4, the sodium tripolyphosphate and at least some of the adjuvant(s) are in spray dried base bead form, at least some of the nonionic detergent is absorbed into such beads, and the sodium perborate hydrate is in different particles, which are in mixture with the base beads.

12. A detergent composition according to claim 7, in a hermetically sealed container or package wherein the composition remains non-caking after storage at elevated temperature and is readily pourable from the container or package upon opening thereof.

13. A detergent composition according to claim 11, in a hermetically sealed container or package wherein the composition remains non-caking after storage at elevated temperature and is readily pourable from the container or package upon opening thereof.

14. A detergent composition according to claim 13, in a sealed and resealable capped and necked bottle, wherein the composition remains non-caking after storage for at least four weeks at a temperature of 43° C. and is readily pourable from the bottle upon opening thereof.

15. A detergent composition according to claim 14, in a cap sealed and resealable transparent narrow necked polymeric plastic or glass bottle having a hollow handle communicating with the bottle interior, with the neck opeing being of across-sectional area of 2 to 40 square centimeters and the handle opening being of a cross-sectional area of 1 to 10 sq. cm., wherein the composition remains non-caking and free flwoing after storage of four weeks at 43° C. and is readily pourable through the handle opening and from the bottle upon removal of the cap therefrom after cooling of the contents.

16. Sodium perborate hydrate particles, of moisture content in the range of 12 to 15%, having absorbed therein a nonionic detergent which is in solid state at room temperature (25° C.).

17. Perborate-nonionic detergent particles according to claim 16 wherein the nonionic detergent is selected from the grup consiting of condensation products of ethylene oxide with higher fatty alcohol and condensation products of ethylene oxide with alkyl phenol, and the particles are of sizes within the range of No's. 8 to 140, U.S. Sieve Series.

18. Perborate-nonionic detergent particles according to claim 17 wherein the nonionic detergent is coated onto and absorbed in the perborate hydrate particles, the nonionic detergent is a condensation product of 3 to 20 moles of ethylene oxide per mole of higher fatty alcohol of 10 to 18 carbon atoms, and is in liquid state at 50° C., the perborate hydrate is of a moisture content in the range of 12 to 14%, and the proportion of nonionic detergent in the perborate-nonionic detergent particles is within the range of 20 to 30%, by weight.

19. A detergent composition in a cap sealed and resealable transparent narrow necked bottle, in accordance with claim 15, which composition consists essentially of about 17% of the nonionic detergent, about 46% of sodium tripolyphosphate, about 17% of sodium perborate hydrate, about 3% of sodium silicate, about 1% of a phosphoric acid ester of a mixture of approximately equal parts of cetyl and stearyl alcohols, about 0.9% of proteolytic enzyme, about 0.5% of magnesium silicate, and about 13% of water, including that which is removable from any hydrates at 105° C.

* * * * *